United States Patent [19]

Anderson

[11] Patent Number: 4,711,378

[45] Date of Patent: Dec. 8, 1987

[54] SPRAY CAP ASSEMBLY COMPRISING A BASE UNIT AND PUSH/PULL CLOSURE MEANS

[75] Inventor: John J. Anderson, Racine County, Wis.

[73] Assignee: S. C. Johnson & Son, Inc., Racine, Wis.

[21] Appl. No.: 842,969

[22] Filed: Mar. 24, 1986

[51] Int. Cl.[4] ..... B65D 25/38

[52] U.S. Cl. ..... 222/499; 222/524; 222/546; 222/206; 222/211; 239/456; 239/492

[58] Field of Search ..... 222/206, 211, 213, 492, 222/495, 498, 499, 522, 524, 546; 239/327, 456, 541, 583, 403, 492

[56] References Cited

U.S. PATENT DOCUMENTS

| | | | |
|---|---|---|---|
| 1,716,525 | 6/1929 | Leong | 239/327 |
| 2,112,125 | 3/1938 | Bultzingslowen | 222/484 |
| 2,179,423 | 11/1939 | Pari | 222/546 |
| 2,531,745 | 11/1950 | Schopmeyer | 239/327 |
| 2,649,334 | 8/1953 | Schneider | 239/327 |
| 2,790,582 | 4/1957 | Halpern | 222/481.5 |
| 2,808,966 | 10/1957 | Hall et al. | 222/207 |
| 2,877,918 | 3/1959 | Gardner | 222/498 X |
| 2,924,393 | 2/1960 | Robert | 239/327 |
| 2,931,543 | 4/1960 | Thomas | 222/546 |
| 2,961,169 | 11/1960 | Nyden | 222/211 X |
| 2,991,913 | 7/1961 | Goth | 222/153 |
| 3,085,721 | 4/1963 | Goldstein | 222/484 |
| 3,122,285 | 2/1964 | Pluess | 222/464 |
| 3,185,352 | 5/1965 | Ghisolfi | 222/635 |
| 3,255,933 | 6/1966 | Martin | 222/209 |
| 3,255,934 | 6/1966 | Leonard | 222/211 |
| 3,276,641 | 10/1966 | Lehmann | 222/526 |
| 3,330,446 | 7/1967 | Grussen et al. | 222/213 |
| 3,341,130 | 9/1967 | Weber | 239/327 |
| 3,392,886 | 7/1968 | Albert et al. | 222/212 |
| 3,401,845 | 9/1968 | Bach | 222/211 |
| 3,409,182 | 11/1968 | McDonnell | 222/211 |
| 3,474,936 | 10/1969 | McDonnell | 222/211 |
| 3,606,107 | 9/1971 | Ardito et al. | 222/546 |
| 3,705,668 | 12/1972 | Schwartzman | 222/207 |
| 3,724,723 | 4/1973 | Slavinski | 222/215 X |
| 3,794,247 | 2/1974 | Corsette | 239/327 |
| 3,874,563 | 4/1975 | Schwartzman | 222/213 |
| 3,987,938 | 10/1976 | Cooprider et al. | 222/209 |
| 4,020,979 | 5/1977 | Shay et al. | 222/211 |
| 4,074,861 | 2/1978 | Magers et al. | 239/492 |
| 4,122,979 | 10/1978 | Laauwe | 222/633 |
| 4,157,789 | 6/1979 | Laauwe | 222/211 X |
| 4,223,842 | 9/1980 | Hayes | 239/327 |
| 4,226,367 | 10/1980 | Hayes | 239/327 |
| 4,239,132 | 12/1980 | Mueller et al. | 222/212 |
| 4,340,157 | 7/1982 | Darner | 222/211 |
| 4,415,122 | 11/1983 | Laauwe | 239/327 |
| 4,420,100 | 12/1983 | Mueller | 222/205 |

FOREIGN PATENT DOCUMENTS 544334 6/1956 Italy .

*Primary Examiner*—Robert J. Spar
*Assistant Examiner*—Jay I. Alexander

[57] ABSTRACT

A spray cap assembly comprising a base unit including a dispensing duct in communication with separate air and material passages, and an insertable push/pull closure mated to fit into the base unit which permits the sealing of the air and material passages from the dispensing duct and from each other. The spray cap assembly by modification to the design of the dispensing duct permits the dispensing of a variety of products having a variety of consistencies as a spray from the squeeze container.

4 Claims, 5 Drawing Figures

30
31
33
36
37
32
34
24
29
16
22
18
20
10
12
40
5
52
54
56

30
31
33
36
37
32
34
29
24
22
26
17
25
20
18
3
10
12
14

12
16
22
24
17
23
25
20
18

52
58
56
50

SPRAY CAP ASSEMBLY COMPRISING A BASE UNIT AND PUSH/PULL CLOSURE MEANS

FIELD OF INVENTION

This invention relates to a push/pull spray cap assembly. More particularly, the invention relates to a spray cap assembly for a container made of a resilient material having a base unit including a dispensing duct in communication with an air passage and a material passage, and an insertable push/pull closure mated to fit into the base unit which permits the sealing of the air and material passages from the dispensing duct and from each other. The assembly, by modifying the design of the dispensing duct permits the dispensing of a variety of products having varying consistencies contained in the resilient container as a spray or mist by exertion of pressure on the walls of the container, such as by squeezing the container in the hand of the user.

BACKGROUND AND PRIOR ART

Squeeze bottles, i.e., bottles made of a resilient material which can have the contents thereof discharged by external pressure exerted on the walls of the bottle, have been used for a long time primarily due to convenience and cost. More recently these squeeze dispensers have become increasingly attractive for the dispensing of various products as sprays or mists due at least in part to the ecological problems encountered with aerosols, or due to cost or flammability problems associated with aerosols designed to overcome the ecological problems. The term "aerosol" is used herein in the broad sense to designate any package where the discharge of a material from a container as a spray or mist is aided by a compressible or liquefied gas, even though the spray or mist is not necessarily a true aerosol. These spray squeeze bottle dispensers have utilized a variety of closures including a push/pull closure assembly with separate air and fluid passages. The push/pull closures disclosed are mounted within a neck of a squeeze bottle; and, in order to prevent fluid material from being dispensed when not in use, the entire push/pull closure assembly is pushed into the neck of the bottle.

Thus, U.S. Pat. No. 3,330,446 discloses a push/pull spray head for a squeeze bottle dispenser having separate air and fluid material passages therein. The air and fluid material passages each enter a discharge duct wherein the air joins with the fluid material and are expelled simultaneously through a discharge orifice in the form of a spray. The dispenser is closed by pushing the entire spray head assembly into the neck of the squeeze bottle. U.S. Pat. No. 3,255,934 discloses a push/pull spray assembly fitted inside the neck of a squeeze bottle. Separate air and material passages are formed in the body of the push/pull assembly. Each passage enters a discharge duct prior to exiting a discharge orifice at the end of the duct as a spray. The dispenser is closed by pushing the push/pull assembly into the neck of the squeeze bottle. U.S. Pat. No. 2,961,169 discloses a closure for a squeeze container which fits within the neck of the container. The closure is a pluglike member having a slot formed therein so that air can move from the interior of the container into a discharge duct. The air combines with and is discharged with fluid material entering the discharge duct by a separate passage formed in the pluglike member. The fluid material and air are discharged as a spray. The container is closed by pushing the pluglike member inside the neck of the container. Although the above assemblies shown in the art have substantial advantages, they have in common the fact that the entire push/pull assembly is pulled out of the neck of the squeeze bottle to open the assembly and pushed into the neck to close the assembly. The material dispensing and air passages are thus closed by engaging a neck part of the container or the closure assembly. As a result, closure parts can become fouled with product residue retained thereon which, over time, becomes unsightly. Additionally, the interfitting of the slidable parts can permit leakage or the loss of volatile components from the products to be dispensed. Further, the orifice in these assemblies, while adjoining, function primarily as a vapor tap and cause or permit only limited mixing of the product and air at the time of spraying and, accordingly, the break-up of the product into a fine aerosol-like spray is not realized.

Squeeze bottle dispensers utilizing a swirl chamber insert with separate fluid material and air passages located inside the spray head are also known. The material and air passages abut and have openings into a channel formed by a swirl chamber insert. Thus, U.S. Pat. No. 4,157,789 discloses a right angle spray nozzle having a swirl chamber insert with a fluid material passage and air passage in communication with a discharge duct and outlet formed by the swirl chamber insert. The manner of closing the discharge orifice is by rotating a wall-containing member in front of the discharge orifice. U.S. Pat. No. 4,020,979 also discloses a squeeze bottle spray dispenser utilizing a swirl chamber insert. As shown therein, a material passage which flows through a post in the swirl chamber and an air passage are in communication with a discharge duct formed by the swirl chamber insert. The fluid material and air exit together through the discharge orifice in the form of a spray. As is apparent, these dispenser assemblies do not have a push/pull member or provide a means of sealing the fluid material and air passages. The closure means disclosed is the rotation of a wall-containing member in front of the discharge orifice. The assemblies are relatively complex and, accordingly, are relatively costly and leave room for malfunctioning, including by plugging.

Squeeze bottle dispensers having a fluid material passage and an air passage formed in the outlet wall of a dispenser with the fluid material and air passages being closed by a flip cap having two downwardly extending posts which fit into the fluid material and air passages simultaneously to seal the passages are disclosed in U.S. Pat. Nos. 2,991,913 and 3,724,723. According to these patents, while the squeeze bottle dispensers have separate fluid material and air passages formed in the discharge outlet wall thereof, these patents do not teach a push/pull member or a right angle spray.

Accordingly, while the art of squeeze bottle dispensers discloses dispensers utilizing a push/pull assembly having separate fluid material and air passages therein which exit through a common discharge orifice, the entire push/pull assembly is pushed into the neck of the dispenser to prevent fluid material from exiting the dispenser when the dispenser is not in use. No patent discloses a push/pull assembly having a swirl chamber insert in the discharge orifice of the assembly. Further, while the art discloses a squeeze spray dispenser having a right angle discharge orifice having separate air and fluid material passages in communication with a discharge duct formed with a swirl chamber insert, no patent discloses a push/pull structure or a means of preventing air and fluid material from entering the discharge duct when the dispenser is inverted.

OBJECTS AND GENERAL DESCRPITION OF INVENTION

Accordingly, it is a primary object of the present invention to provide a push/pull closure assembly for a container composed of a resilient material which permits the dispensing of a variety of products having varying consistencies contained in the resilient container as a spray by exertion of external pressure on the container, such as by squeezing the container in the hand of the user.

It is another primary object of this invention to provide a closure assembly for a container of a resilient material composed of a base unit including a right angle dispensing orifice in communication with a material passage and an air passage, and an insertable push/pull closure interfitted to the base unit for closing off the material and air passages and separating the air passage from the material passage.

It is another primary object of this invention to provide a closure assembly for a container of a resilient material composed of a base unit including a right angle dispensing orifice in communication with a material passage and an air passage, with the orifice designed to intermix air with the material being dispensed.

These and other objects of the invention will become apparent from the following general description of the invention and from the detailed description of the presently preferred embodiment.

The above primary and other objects of the present invention are accomplished by providing a spray cap assembly comprising a base unit and a push/pull closure. The base unit, designed to be attached to the neck of a squeeze bottle, includes a skirt portion for releasable attachment to a squeeze bottle and integral therewith an annular sidewall portion containing a discharge duct above the skirt portion. A separating wall at right angles to the annular sidewall portion is located inside the body of the base unit at or, substantially at the level of the discharge duct formed in the sidewall of the base unit. First and second adjacent tubular passages are positioned inside the base unit. The first passage, which is the material-dispensing passage, extends above and below the separating wall, abuts a discharge chamber containing a discharge orifice, and has an opening in the passage wall communicating with the discharge duct. The end of the passage extending below the separating wall is in communication through a dip tube with the interior of a squeeze bottle when the spray cap is attached to a squeeze bottle. The second passage, which is an air passage extends above the separating wall, abuts the discharge duct, and has an opening into the discharge duct. The passage is in gaseous communication with the interior of the squeeze bottle when the spray cap is attached thereto. The fluid material contained in the squeeze bottle is forced into the first passage and through the discharge duct by manual squeezing of the bottle. Simultaneously, by the same squeezing pressure, air is forced into the second passage and enters the discharge duct through the opening in the passage. The air forced into the discharge duct provides for a smooth flow of the fluid material from the dispenser; mixes with the material being dispensed, thus aiding in the formation of a spray of the dispensed material; and provides an air inlet for reinflating the squeeze bottle. A cup-shaped insert is placed in the discharge duct to form an annular passage to direct the air to the swirl chamber in the discharge duct to improve the spraying capabilities of the dispenser.

The push/pull closure of the spray cap assembly controls the ability of the fluid material and air to enter the discharge duct or chamber. The push/pull closure has a flat end and an annular body which extends downwardly from the flat end. The flat end preferably has a larger circumference than the annular body of the base unit to permit a user to pull the closure upward when the closure is positioned in the base unit. The closure has two adjacent posts which may either be hollow or solid integral with the inside of the flat end, and which extend downwardly into and beyond the bottom edge of the annular body. The closure is mated to fit inside the inner circumference of the base unit, with the two posts fitting inside the two tubular passages of the base unit. Projections are located on the outside wall of the annular body closure which operate in conjunction with a shoulder formed in the inside of the annular sidewall portion of the base unit to prevent the closure from being removed from the base unit when pulled upward. The position of, and the length of the two downwardly extending posts is such that the posts will mate with and remain seated within but at the top of the two passages of the base unit when the closure is pulled upward, but at the same time will not block the openings of the two passages into the discharge chamber of the base unit. Therefore, when the closure is pulled upward and the body of the squeeze bottle is squeezed, fluid material and air are forced into the passages and through the openings into the discharge orifice where the fluid material and air simultaneously move into the atmosphere as a spray. When the closure is pushed downward into the base unit, the posts slide downward in the passages blocking or closing the openings from the passages to the discharge duct, thereby preventing any air or fluid material from being dispensed or leaking out of the squeeze bottle, and from each other.

The spray cap assembly of the present invention is of simple construction, attractive, and provides for the construction of a squeeze bottle for dispensing products of varying consistency simply by modifying the discharge duct, including by use of an insert in the orifice so as to provide a swirl chamber. Moreover, the spray cap provides a good seal when not in use, avoiding loss of product by leakage or evaporation. The spray cap is easy for the ultimate consumer to use.

THE DRAWING AND DETAILED DESCRIPTION OF THE PRESENTLY PREFERRED EMBODIMENT

Having described the novel spray cap assembly in general terms, a detailed description of the presently preferred embodiment will be described in relation to the drawing wherein FIG. 1 is an exploded perspective view, partially broken away, of the spray cap assembly attached to a squeeze bottle;

Figure 1:
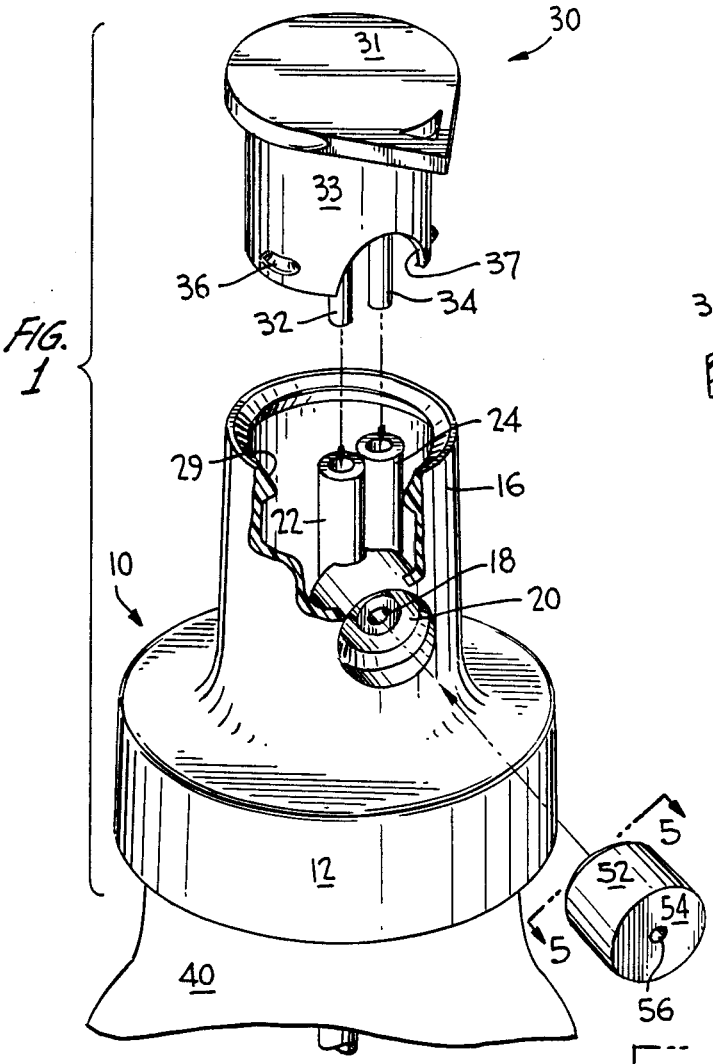
Figure 2:
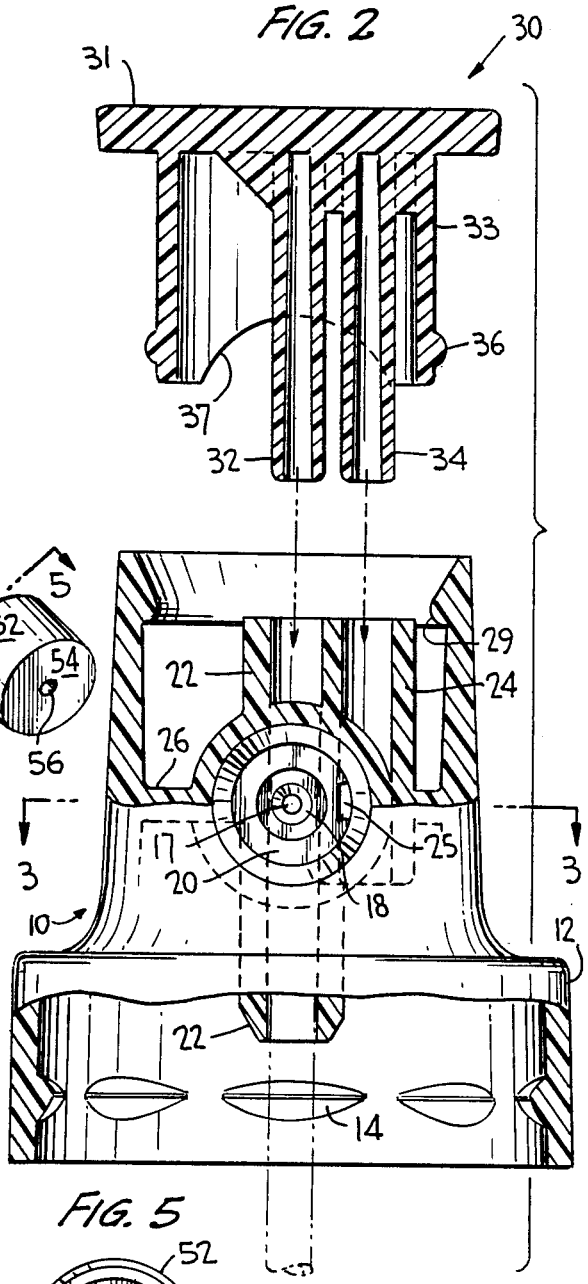
FIG. 2 is an exploded elevational view, partially broken away, of the spray cap assembly.
Figure 3:
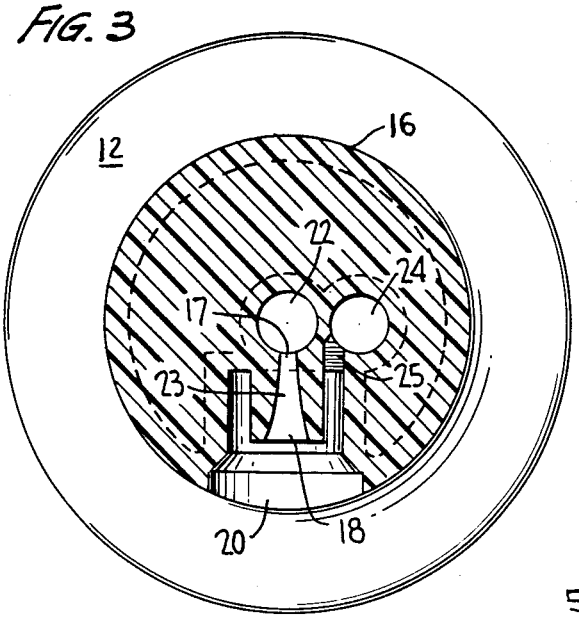
FIG. 3 is a cross-sectional view of the base unit of the spray cap assembly taken along line 3—3 of FIG. 2.

Referring to the drawing, the spray cap assembly is composed of a base unit 10 and a push/pull closure 30. Base unit 10 comprises a skirt 12 which fits over and snaps onto neck 42 of a squeeze container 40 by means of cooperating indents 44 in neck 42 and protrusions 14 in skirt 12. An annular sidewall portion 16 of smaller diameter than skirt 12 is integral with and extends above skirt 12.

Annular sidewall 16 has a discharge orifice chamber 20 recessed into annular sidewall 16 surrounding an orifice 18. Chamber 20 is in communication with parallel passages 22 and 24 through openings 23 and 25, respectively. Passage 22, which is the material-dispensing passage, extends above and below a separating wall 26 which is at right angles to annular sidewall 16, and is thus in communication through a dip tube 46 with the interior of squeeze bottle 40 and with the external atmosphere through opening 23, chamber 20, and orifice 18. Passage 24, which is an air passage, extends above separating wall 26 and terminates at, or substantially at wall 26 and is in gaseous communication with the interior of squeeze bottle 40 and with the atmosphere through opening 25 and chamber 20.

Push/pull closure 30 comprises a flat end 31 and integral therewith downwardly extending annular closure sidewall 33. Two parallel posts 32 and 34 extend downwardly from inside of top 31. Closure 30 fits into base unit 10 with posts 32 and 34 fitting into passages 22 and 24, respectively. Cut-out 37 in wall 33 provides a clearance over chamber 20. The closure is retained in base unit 10 by protrusion 36 extending outwardly from wall 33 of closure 30 which engages lip 29 at the inside of sidewall 16 of the base unit. As shown, posts 32 and 34 are sufficiently long so as to be within passages 22 and 24 even when the closure is open as shown in FIG. 4.

In operation, push/pull closure 30 is inserted into base unit 10, and base unit 10 containing dip tube 46 is attached to squeeze bottle 40. If a larger diameter dip tube 46 is used, it can fit over the outside of passage 22. The attachment of base unit 10 to bottle 40 must form a seal. If rim 62 of bottle 40 is sufficiently flat to form an airtight seat with shoulder 64 of base unit 10, no additional sealing is required. However, if rim 62 has any irregularities, it may be advisable to use a gasket (not shown) or other means to provide a complete seal between bottle 40 and base unit 10. When closure 30 is in the up or open position as shown in solid lines in FIG. 4, post units 32 and 34 are retained in parallel passages 22 and 24. However, passages 22 and 24 are in communication through passage 23 and opening 25 with chamber 20 and orifice 18. When external pressure is exerted on the sidewalls of container 40, material within the container passes up dip tube 46 through passage 22 and passage 23, and out orifice 18. Simultaneously with the dispensing of product from within the container 40, air passes through passage 24 and through opening 25 in the wall of passage 24 into chamber 20. Passage 23 has orifice 18 and internal orifice 17. The diameter of passage 23 increases gradually along the length of passage 23 from internal orifice 17 to orifice 18. This slows the velocity of the liquid being dispensed from bottle 40 and aids in breaking up the liquid to produce a fine spray. Because of the shape or configuration of chamber 20 surrounding orifice 18, the air intimately mixes with and breaks up the product to provide a fine spray or mist. Upon release of pressure on bottle 40, the vacuum created draws air through opening 56, through ribs 58, through opening 25, and through second passage 24 into the interior of bottle 40. Also, some air is simultaneously drawn through passage 23, passage 22, and dip tube 46.

Figure 4:
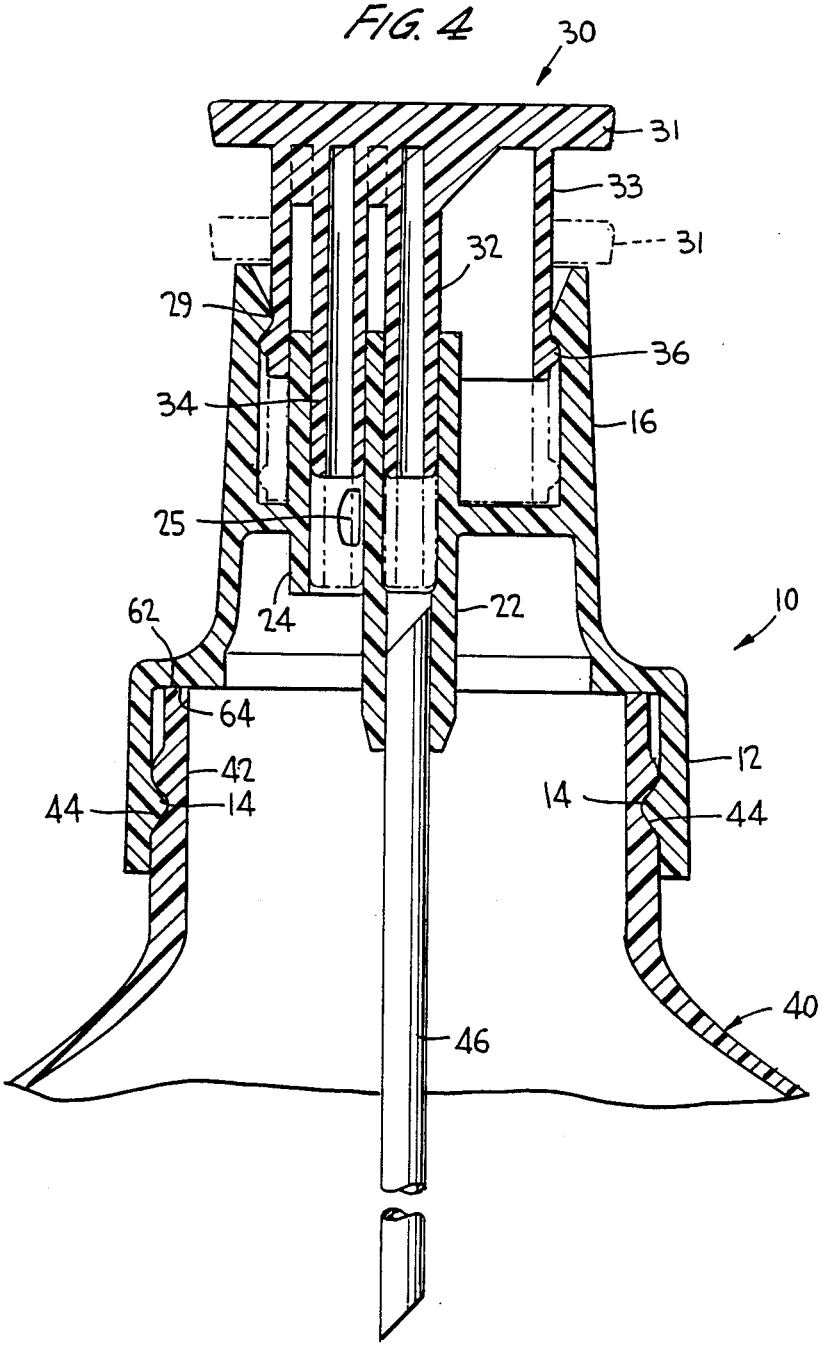
FIG. 4 is a cross-sectional view taken from the rear toward the front of the spray cap assembly attached to a spray bottle showing the push/pull closure unit in solid lines in the open position and in phantom lines in the closed position.

After spraying is discontinued and when the product is in the stored condition, push/pull closure 30 is pressed down as shown in phantom lines in FIG. 4. When in the down or closed position, posts 32 and 34 block and seal passages 22 and 24 at, or substantially at the level of separating wall 26. In this position not only are passages 22 and 24 closed from the atmosphere, but also the passages are separated from each other. As is apparent, therefore, the push-pull closure permits the opening and closing of the parallel air and material passages with a simple movement while providing a tight seal.

Figure 5:
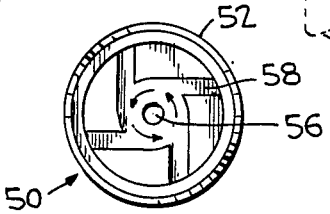
FIG. 5 is a view taken from the rear of a discharge chamber insert designed to provide a swirl chamber in the chamber.

The spray pattern of the spray cap assembly is modified by the utilization of an insert in orifice chamber 20. A suitable swirl insert 50 is shown in FIGS. 1 and 5. As shown in FIGS. 1 and 5, the insert comprises annular wall 52 and wall 54 at right angles to the annular wall 52 having an opening 56. A series of depressed ribs 58 are positioned on wall 54 inside of wall 52 to provide a break-up of product being sprayed and mixing of the product with air to provide the desired spray pattern. The spray cap can be modified to dispense a wide variety of liquids having different viscosities. Three of the elements which affect the spray pattern are the diameter of dip tube 46, the diameter of orifices 18 and 17, and the diameter of orifice 56. Other openings can be modified in addition to the above, however these have the greatest impact on the spray pattern.

As will be apparent to one skilled in the art, various modifications can be made within the scope of the aforesaid description. Such modifications being within the ability of one skilled in the art form a part of the present invention and are embraced by the appended claims.

It is claimed:

1. A spray cap assembly for attachment to a resilient container comprising a base unit including a skirt portion for attachment to a resilient container, an annular sidewall portion positioned above said skirt portion integral therewith, a discharge chamber recessed into said sidewall portion, an orifice in said discharge chamber extending through said annular sidewall portion, a separation wall within said annular sidewall portion and extending at right angles to said annular sidewall, first and second parallel tubular passages extending through said separation wall, the first of said passages having an opening therein to place said passage in communication with said orifice and the second of said passages having an opening therein to place said passage in communication with said discharge chamber; an insert in said discharge chamber having a dispensing hole to form a product-air mixing chamber behind said insert, said hole being in communication with said orifice and with the opening in the second passage; a push/pull closure comprising a closed end, an annular closure sidewall extending downwardly from said closed end, said annular closure sidewall being positioned within said annular sidewall portion of said base unit, and parallel posts extending downwardly from said closed end within said annular closure sidewall mated to and positioned within said first and second passages of said base unit; said base unit and closure being constructed and arranged whereby when said closure is in an open position said tubular passages are in communication with said orifice and discharge chamber through said openings therein and when said closure is in the closed position said openings in said tubular passages are sealed, and whereby said annular closure sidewall and the base unit annular sidewall portion cooperate to guide and limit movement of said closure between the open and closed positions.

2. The spray cap assembly of claim 1 wherein said orifice is in the form of a cylindrical nozzle positioned in said discharge chamber and spaced from the outer diameter of said annular sidewall, said opening in said second passage being in communication with said discharge chamber rearward of said orifice.

3. The spray cap assembly of claim 2 wherein said insert comprises an end containing said dispensing hole and an annular sidewall extending from said end and fitted into said discharge chamber, said end having a plurality of ribs on the inside of said end to aid in mixing.

4. In combination, a squeeze container, a dip tube, and the spray cap assemblv of claim 1 positioned on said squeeze container, the first of said parallel passages of said assembly being in communication below said separation wall with a dip tube with said dip tube extending into said container and into contact with a product in said container, and said second of said parallel passages being in gaseous communication with said squeeze container whereby, when external pressure is exerted on said container, product passes through said dip tube into said first passage to said chamber through said orifice, and whereby air passes to said chamber rearward of said orifice simultaneously with said product and mixes with said product in said chamber, said product and air being propelled through said dispensing hole in said insert as a spray.

* * * * *